US009004155B2

(12) United States Patent
Chalker et al.

(10) Patent No.: US 9,004,155 B2
(45) Date of Patent: Apr. 14, 2015

(54) PASSIVE COMPLETION OPTIMIZATION WITH FLUID LOSS CONTROL

(75) Inventors: Christopher J. Chalker, Aberdeen (GB); Jody R. McGlothen, Waxahachie, TX (US); Robert K. Buckner, Rowlett, TX (US); Tommy L. Stambaugh, Allen, TX (US); Floyd R. Simonds, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1864 days.

(21) Appl. No.: 11/851,354

(22) Filed: Sep. 6, 2007

(65) Prior Publication Data

US 2009/0065195 A1 Mar. 12, 2009

(51) Int. Cl.

| | |
|---|---|
| ***E21B 34/06*** | (2006.01) |
| ***E21B 33/124*** | (2006.01) |
| ***E21B 33/12*** | (2006.01) |
| ***E21B 43/08*** | (2006.01) |
| ***E21B 43/12*** | (2006.01) |

(52) U.S. Cl.

CPC ..... *E21B 33/124* (2013.01); *E21B 33/1208* (2013.01); *E21B 43/08* (2013.01); *E21B 43/12* (2013.01)

(58) Field of Classification Search

CPC ..... E21B 34/06
USPC ..... 166/51, 278, 373, 374
See application file for complete search history.

(56) References Cited

U.S. PATENT DOCUMENTS

| | | | |
|---|---|---|---|
| 2,762,437 | A | 9/1956 | Egan et al. |
| 2,849,070 | A | 8/1958 | Maly |
| 2,945,541 | A | 7/1960 | Maly |
| 2,981,332 | A | 4/1961 | Miller |
| 2,981,333 | A | 4/1961 | Miller |

(Continued)

FOREIGN PATENT DOCUMENTS

| | | |
|---|---|---|
| GB | 2314866 | 1/1998 |
| GB | 2356879 | 6/2001 |

(Continued)

OTHER PUBLICATIONS

SPE 102208, "Means for Passive Inflow Control Upon Gas Breakthrough," dated Sep. 24-27, 2006.

(Continued)

*Primary Examiner* — Shane Bomar
*Assistant Examiner* — Kipp Wallace
(74) *Attorney, Agent, or Firm* — Smith IP Services, P.C.

(57) ABSTRACT

Passive completion optimization with fluid loss control. A completion string includes a set of well tools interconnected as a portion of the completion string, the well tools including a well screen assembly, at least one valve which controls fluid communication between an interior and exterior of the string, and two packer assemblies, each of the packer assemblies including at least one swellable seal element, and the packer assemblies longitudinally straddling the valve and the screen assembly. Another completion string includes a set of well tools interconnected as a portion of the completion string, the well tools including two packer assemblies, a well screen assembly, and the screen assembly including an inflow control device which restricts fluid flow through the screen assembly, each of the packer assemblies including a swellable seal element, and the packer assemblies longitudinally straddling the screen assembly.

9 Claims, 2 Drawing Sheets

(56) References Cited

U.S. PATENT DOCUMENTS

| | | | | |
|---|---|---|---|---|
| 3,477,506 | A | 11/1969 | Malone | |
| 4,137,970 | A * | 2/1979 | Laflin et al. | 166/292 |
| 4,287,952 | A | 9/1981 | Erbstoesser | |
| 4,491,186 | A | 1/1985 | Alder | |
| 4,862,967 | A | 9/1989 | Harris | |
| 4,974,674 | A | 12/1990 | Wells | |
| 4,998,585 | A | 3/1991 | Newcomer | |
| 5,333,684 | A | 8/1994 | Walter | |
| 5,337,821 | A | 8/1994 | Peterson | |
| 5,435,393 | A | 7/1995 | Brekke | |
| 5,673,751 | A | 10/1997 | Head | |
| 5,730,223 | A | 3/1998 | Restarick | |
| 5,803,179 | A | 9/1998 | Echols | |
| 5,896,928 | A | 4/1999 | Coon | |
| 6,112,815 | A | 9/2000 | Boe | |
| 6,112,817 | A | 9/2000 | Voll | |
| 6,253,861 | B1 | 7/2001 | Carmichael | |
| 6,305,470 | B1 | 10/2001 | Woie | |
| 6,371,210 | B1 | 4/2002 | Bode | |
| 6,431,282 | B1 | 8/2002 | Bosma | |
| 6,478,091 | B1 | 11/2002 | Gano | |
| 6,488,082 | B2 | 12/2002 | Echols et al. | |
| 6,505,682 | B2 | 1/2003 | Brockman | |
| 6,516,888 | B1 | 2/2003 | Gunnarson | |
| 6,622,794 | B2 | 9/2003 | Zisk | |
| 6,679,324 | B2 | 1/2004 | Den Boer | |
| 6,695,067 | B2 | 2/2004 | Johnson | |
| 6,719,051 | B2 | 4/2004 | Hailey | |
| 6,786,285 | B2 | 9/2004 | Johnson | |
| 6,817,416 | B2 | 11/2004 | Wilson | |
| 6,834,725 | B2 | 12/2004 | Whanger | |
| 6,848,505 | B2 | 2/2005 | Richard et al. | |
| 6,851,560 | B2 | 2/2005 | Reig | |
| 6,857,475 | B2 | 2/2005 | Johnson | |
| 6,857,476 | B2 | 2/2005 | Richards | |
| 6,886,634 | B2 | 5/2005 | Richards | |
| 6,907,937 | B2 | 6/2005 | Whanger | |
| 7,059,401 | B2 | 6/2006 | Bode | |
| 7,063,162 | B2 | 6/2006 | Daling | |
| 7,070,001 | B2 | 7/2006 | Whanger et al. | |
| 7,096,945 | B2 | 8/2006 | Richards et al. | |
| 7,100,686 | B2 | 9/2006 | Wittrisch | |
| 7,108,083 | B2 | 9/2006 | Simonds et al. | |
| 7,134,505 | B2 * | 11/2006 | Fehr et al. | 166/387 |
| 7,562,709 | B2 * | 7/2009 | Saebi et al. | 166/278 |
| 2002/0056553 | A1 | 5/2002 | Duhon | |
| 2004/0020662 | A1 | 2/2004 | Freyer | |
| 2004/0035590 | A1 | 2/2004 | Richard | |
| 2004/0060706 | A1 | 4/2004 | Stephenson | |
| 2004/0112609 | A1 | 6/2004 | Whanger | |
| 2004/0144544 | A1 | 7/2004 | Freyer | |
| 2005/0016732 | A1 | 1/2005 | Brannon | |
| 2005/0110217 | A1 | 5/2005 | Wood | |
| 2005/0173130 | A1 | 8/2005 | Richard | |
| 2005/0199401 | A1 * | 9/2005 | Patel et al. | 166/387 |
| 2006/0060352 | A1 * | 3/2006 | Vidrine et al. | 166/276 |
| 2006/0076150 | A1 | 4/2006 | Coronado | |
| 2006/0113089 | A1 | 6/2006 | Henriksen | |
| 2006/0118296 | A1 | 6/2006 | Dybevik | |
| 2006/0185849 | A1 | 8/2006 | Edwards | |
| 2007/0044962 | A1 * | 3/2007 | Tibbles | 166/278 |
| 2007/0163777 | A1 | 7/2007 | Murray et al. | |
| 2007/0246210 | A1 | 10/2007 | Richards | |
| 2007/0246213 | A1 | 10/2007 | Hailey | |
| 2007/0246225 | A1 | 10/2007 | Hailey | |
| 2007/0246407 | A1 | 10/2007 | Richards | |
| 2008/0041588 | A1 * | 2/2008 | Richards et al. | 166/265 |
| 2008/0156496 | A1 | 7/2008 | East | |
| 2009/0008092 | A1 * | 1/2009 | Haeberle et al. | 166/278 |

FOREIGN PATENT DOCUMENTS

| | | |
|---|---|---|
| GB | 2371578 | 7/2002 |
| GB | 2406593 | 4/2005 |
| GB | 2341405 | 3/2006 |
| WO | 02059452 | 8/2002 |
| WO | WO02075110 | 9/2002 |
| WO | 2004057715 | 7/2004 |
| WO | 2005052308 | 6/2005 |
| WO | 2005116394 | 12/2005 |
| WO | 2006003112 | 1/2006 |
| WO | 2006003113 | 1/2006 |

OTHER PUBLICATIONS

International Search Report for PCT/NO02/00158.
U.S. Appl. No. 11/671,319, filed Feb. 5, 2007.
U.S. Appl. No. 11/466,022, filed Aug. 21, 2006.
Examination report for GB 0707831.4 dated Jul. 16, 2007.
SPE 25891, "Perforation Friction Pressure of Fracturing Fluid Slurries," Halliburton Services, dated 1993.
U.S. Appl. No. 11/502,074, filed Aug. 10, 2006.
U.S. Appl. No. 11/702,312, filed Feb. 5, 2007.
Weatherford, "Application Answers," product brochure, dated 2005.
Office Action for U.S. Appl. No. 10/477,440 dated Jun. 14, 2006.
Baker Hughes MPas™ packer product report dated Oct. 2001 (1 pg.).
Baker Hughes RCPacker™ product report dated Dec. 2005 (1pg.).
Halliburton PinPoint Completion presentation dated 2006 (3 pgs.).
Halliburton Completion Tools, Delta Stim™ Sleeve dated Mar. 2007 (3 pgs.).
Delta Stim™ Completion, Versaflex drawing (1 pg.).
U.S. Appl. No. 11/609,128, filed Dec. 11, 2006.
U.S. Appl. No. 11/450,654, filed Jun. 9, 2006.
U.S. Appl. No. 11/639,914, filed Dec. 15, 2006.

* cited by examiner

PASSIVE COMPLETION OPTIMIZATION WITH FLUID LOSS CONTROL

BACKGROUND

The present invention relates generally to operations performed and equipment utilized in conjunction with a subterranean well and, in an embodiment described herein, more particularly provides for passive completion optimization with fluid loss control.

It is well known to use packers with swellable seal elements in completion strings for subterranean wells. Such swellable seal elements typically swell to sealingly engage a wellbore wall in response to contact with a fluid in a well.

Unfortunately, however, it may take from approximately one to thirty days for a conventional swellable seal material to swell to a sufficient extent that an effective seal is achieved against the wall of the wellbore. In the meantime, valuable and/or potentially deleterious completion fluids may be lost to the formation surrounding the wellbore, thereby reducing the economic benefit derived from the completion and/or reducing the potential recovery of hydrocarbon fluids from the formation.

Therefore, it may be seen that improvements are needed in the art of completing subterranean wells.

SUMMARY

In carrying out the principles of the present invention, a well system including a well completion string is provided which solves at least one problem in the art. One example is described below in which swellable packer assemblies straddle certain well tools in the completion string. Another example is described below in which the packer assemblies include actuators which operate to extend swellable seal elements of the packer assemblies.

In one aspect, a well completion string is provided which includes at least one set of well tools interconnected as a portion of the completion string. The set of well tools includes at least one well screen assembly, at least one valve which selectively permits and prevents fluid communication between an interior and an exterior of the completion string, and at least two packer assemblies. Each of the packer assemblies includes at least one swellable seal element. The packer assemblies longitudinally straddle the valve and the well screen assembly in the completion string.

In another aspect, a well completion string is provided which includes at least one set of well tools interconnected as a portion of the completion string. The set of well tools includes at least two packer assemblies and at least one well screen assembly, with the well screen assembly including an inflow control device which restricts fluid flow through the screen assembly. Each of the packer assemblies includes at least one swellable seal element. The packer assemblies longitudinally straddle the well screen assembly in the completion string.

These and other features, advantages, benefits and objects will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
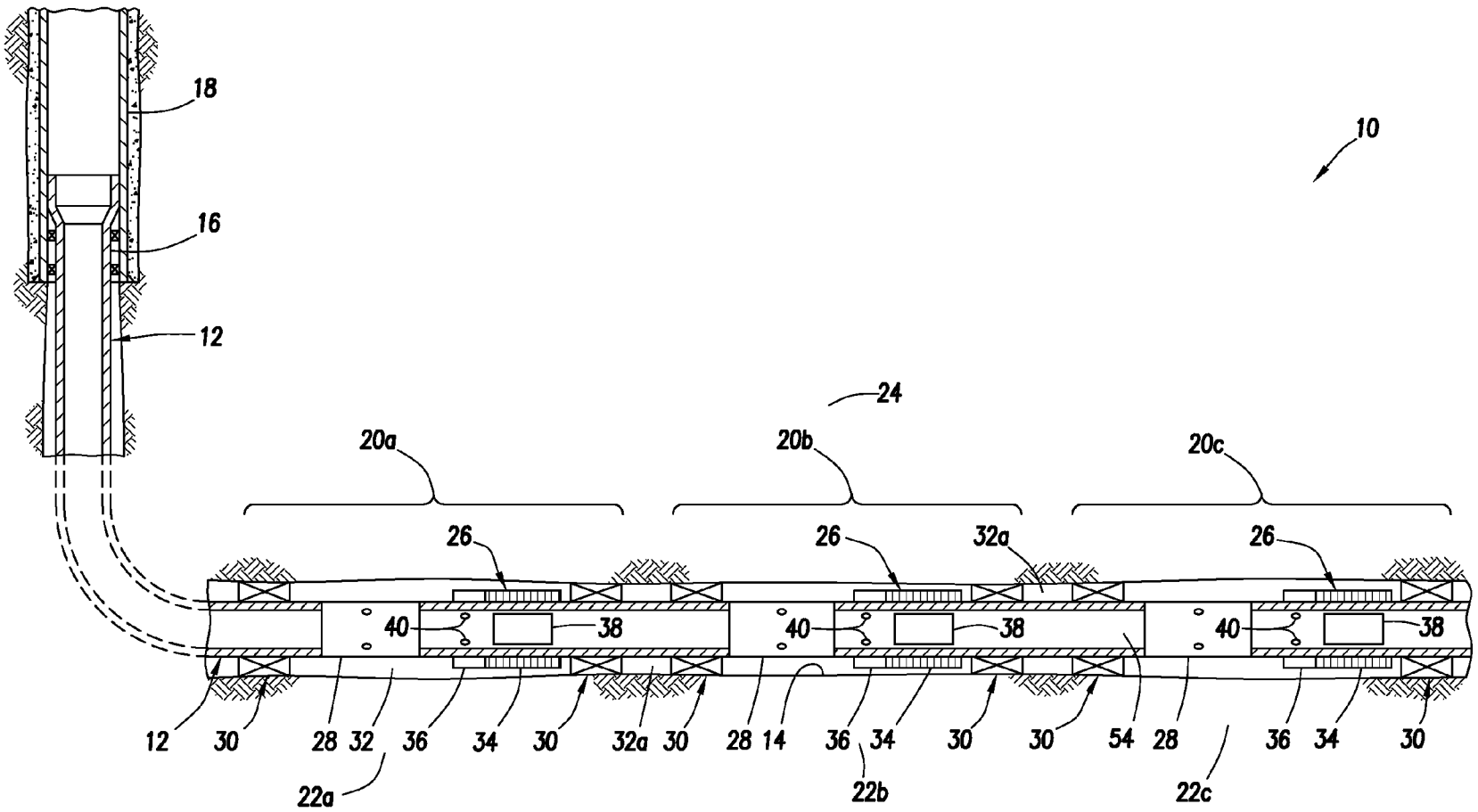
FIG. 1 is a schematic partially cross-sectional view of a well system embodying principles of the present invention.

Representatively illustrated in FIG. 1 is a well system 10 which embodies principles of the present invention. In a completion operation, a generally tubular completion string 12 has been installed in a wellbore 14 of a well. The wellbore 14 is depicted in FIG. 1 as being generally horizontal and uncased (i.e., "open hole"), but the wellbore could be otherwise oriented, and the wellbore could be cased or lined as desired, in keeping with the principles of the invention.

An upper end of the completion string 12 preferably includes an expandable hanger 16 which sealingly secures the completion string within a lower end of a casing string 18 cemented in a generally vertical portion of the wellbore. A suitable expandable liner hanger is the VERSAFLEX™ liner hanger available from Halliburton Energy Services of Houston, Tex., but other hangers and other methods of securing the completion string 12 may be used if desired.

The completion string 12 preferably includes multiple sets of well tools 20 (three of which are respectively indicated in FIG. 1 as 20*a*, 20*b*, 20*c*) interconnected therein. Any number of sets of well tools 20 may be used as desired.

The sets of well tools 20 are used in the well system 10 to control fluid communication between an interior of the completion string 12 and individual zones 22 (three of which are respectively indicated in FIG. 1 as 22*a*, 22*b*, 22*c*) of at least one formation 24 intersected by the wellbore 14. Any number of zones 22 may be produced from, or injected into, using the well system 10.

Each set of well tools 20 preferably includes at least one well screen assembly 26, at least one valve 28 and at least two packer assemblies 30. The packer assemblies 30 longitudinally straddle the valve 28 and screen assembly 26 in each of the well tool sets 20*a*, 20*b*, 20*c*. In this manner, an annulus 32 radially between the completion string 12 and the wall of the wellbore 14 is isolated longitudinally between the packer assemblies 30 by each of the well tool sets 20*a*, 20*b*, 20*c*, and the valve 28 and screen assembly 26 of each well tool set is in communication with the respective isolated annulus portion.

Note that adjacent sets of well tools 20 could share a packer assembly 30 between them, although FIG. 1 depicts isolated portions 32*a* of the annulus 32 between packer assemblies of adjacent sets of well tools. These isolated annulus portions 32*a* could be used to close off thief zones, reduce water production, etc.

The valve 28 is preferably used to selectively permit and prevent fluid communication between the interior and exterior of the completion string 12 at each of the zones 22*a*, 22*b*, 22*c*. That is, the valve 28 controls fluid flow between the interior of the completion string 12 and the annulus 32 between the packer assemblies 30 in each set of well tools 20.

A suitable valve is known as the DELTA STIM™ sleeve valve available from Halliburton Energy Services of Houston, Tex. This valve is particularly suitable for permitting stimulation operations to be performed on the formation 24 after the completion string 12 has been installed and prior to producing from the individual zones 22*a*, 22*b*, 22*c*. Even after production operations have commenced, this valve may be used to control fluid flow between the interior and exterior of the completion string 12 as an alternative to the screen assembly 26.

The screen assembly 26 preferably includes at least one well screen 34 and an inflow control device 36. The well screen 34 may be of any type (such as wire wrapped, sintered metal, expandable, slotted, etc.), and the inflow control device 36 is preferably used to restrict fluid flow through the well screen. This flow restriction is desirable in many instances to balance production from the zones 22*a*, 22*b*, 22*c*, prevent water or gas coning, restrict or exclude production of water or gas, etc.

Suitable inflow control devices are described in the following U.S. patent application Ser. No. 10/47740 filed 29 Mar. 2004, Ser. No. 11/407,848 filed 20 Apr. 2006, Ser. No. 11/409,734 filed 24 Apr. 2006, Ser. No. 11/466,022 filed 21 Aug. 2006, Ser. No. 11/668,024 filed 29 Jan. 2007, and Ser. No. 11/671,319 filed 5 Feb. 2007. The entire disclosures of these prior applications are incorporated herein by this reference.

Of course, other types of inflow control devices may be used for the device 36 in the well system 10 in keeping with the principles of the invention. In particular, the inflow control device 36 is preferably of the type which increasingly restricts fluid flow through the screen assembly 26 (between the interior and exterior of the completion string 12) in response to an increased proportion of water and/or gas in the fluid flow.

The screen assembly 26 may further include a valve 38 for selectively permitting and preventing fluid flow through the screen assembly (between the interior and exterior of the completion string 12). As depicted in FIG. 1, the valve 38 is in the form of a sleeve which is displaced to alternately permit and prevent fluid flow through ports 40. The valve 38 could be used to control fluid flow through the inflow control device 36 and/or the well screen 34. Other types of valves may be used in keeping with the principles of the invention.

Figure 2:
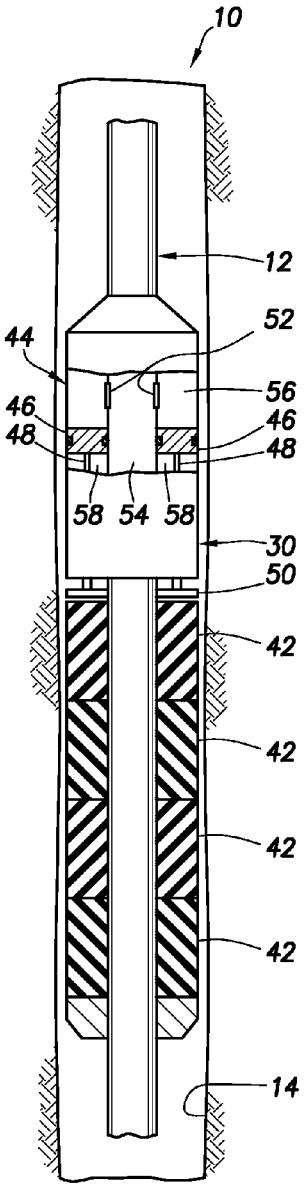
FIG. 2 is an enlarged scale partially cross-sectional schematic view of a packer assembly which may be used in the well system of FIG. 1.

Referring additionally now to FIG. 2, an enlarged scale schematic partially cross-sectional view of one of the packer assemblies 30 is representatively illustrated. As shown in FIG. 2, the packer assembly 30 has been installed in the wellbore 14, but has not yet been set.

The packer assembly 30 preferably includes one or more swellable seal elements 42. The seal elements 42 are particularly applicable for use in uncased wellbores, but could be used in cased wellbores if desired.

The seal elements 42 are made partially or completely of swellable material of the type which swells downhole to sealingly engage a wellbore or interior wall of casing, etc. The swellable material may swell (i.e., increase in volume) in response to contact with a particular fluid (such as water, hydrocarbons, gas, etc.). The swellable material may swell due to a chemical reaction, molecular migration into the material, or by any other process.

Suitable swellable materials are described in the following U.S. patent application Ser. No. 11/407,704 filed 20 Apr. 2006, and in the following international patent applications: PCT/US06/35052 filed 11 Sep. 2006, PCT/US06/60094 filed 20 Oct. 2006, PCT/US06/60926 filed 15 Nov. 2006, and PCT/US07/61703 filed 6 Feb. 2007. The entire disclosures of these prior applications are incorporated herein by this reference. Of course, other types of swellable materials may be used in keeping with the principles of the invention.

The packer assembly 30 is also equipped with an actuator 44 which, in this example, includes one or more pistons 46 with rods attached thereto for transmission of a biasing force to a ring 50 positioned adjacent the seal elements 42. Rupture discs 52 are selected to open at a predetermined pressure differential from the interior 54 of the completion string 12 to chambers 56 above the pistons 46.

Figure 3:
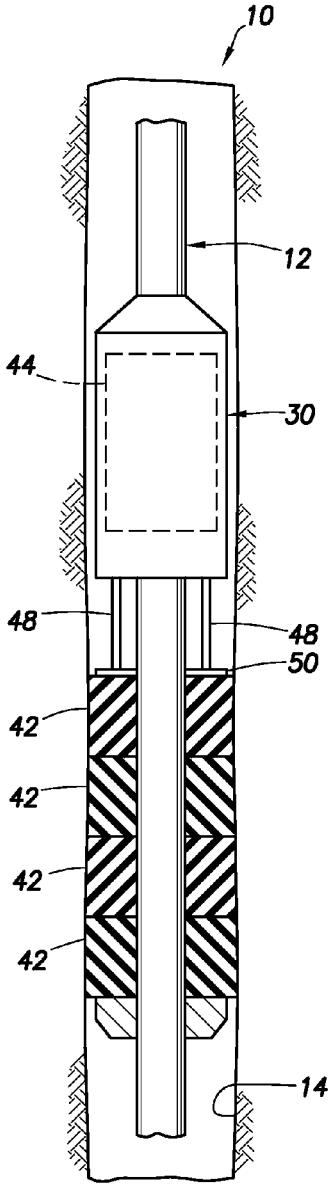
FIG. 3 is a partially cross-sectional schematic view of the packer assembly of FIG. 2 after the packer assembly has been set in a wellbore.

When the rupture discs 52 are opened by increasing pressure in the interior 54 of the completion string 12, a resulting pressure differential from the chambers 56 to chambers 58 below the pistons 46 causes the pistons to apply a downwardly directed biasing force to the ring 50 via the rods 48. In FIG. 3, the packer assembly 30 is depicted after the ring 50 has been downwardly displaced in response to the biasing force.

Note that the actuator 44 is merely described herein as an example of one type of actuator which may be used to apply a biasing force to the seal elements 42. Many other types of actuators could be used in place of, or in addition to, the actuator 44 in keeping with the principles of the invention. For example, a mechanical actuator which operates in response to manipulation of the completion string 12 (e.g., by rotation and/or longitudinal displacement, etc.), an electrical actuator (e.g., including a motor, etc.), a pyrotechnic actuator, another type of hydraulic actuator, or any other type of actuator could be used.

As depicted in FIG. 3, the seal elements 42 have been longitudinally compressed by the biasing force exerted by the actuator 44, resulting in a radially outward extension of the seal elements into sealing contact with the wall of the wellbore 14. It is important to note that the seal elements 42 may be extended outwardly into sealing engagement with the wellbore 14 before, during or after swelling of the seal elements is initiated.

Furthermore, it is an important feature of the packer assembly 30 that it is not necessary to wait until the seal elements 42 have been sufficiently swollen in the wellbore 14 to achieve satisfactory sealing engagement. Instead, sealing engagement between the seal elements 42 and the wellbore 14 may be achieved at any desired time after the packer assembly 30 is properly positioned in the wellbore by activating the actuator 44 to outwardly extend the seal elements.

Figure 4:
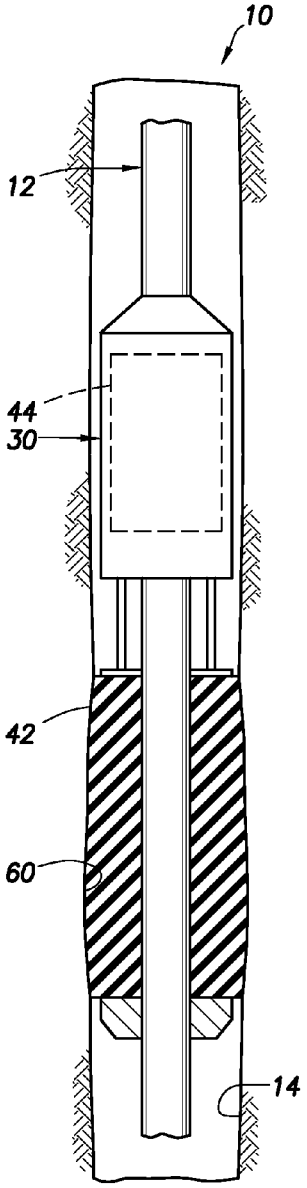
FIG. 4 is a partially cross-sectional schematic view of an alternate construction of the packer assembly of FIG. 2 after the packer assembly has been set in a wellbore and a swellable seal element of the packer assembly has sealingly engaged an enlarged portion of the wellbore.

Thereafter, the seal elements 42 can begin or continue to swell to thereby enhance the sealing engagement with the wellbore 14. In this manner, large irregularities (such as washouts, etc.) on the wellbore 14 wall can be accommodated. In FIG. 4, the packer assembly 30 is representatively illustrated after the seal element 42 (a single seal element in this case) has swollen sufficiently, and after the actuator 44 has been activated, so that the seal element sealingly engages a washout 60 in the wall of the wellbore 14.

Use of the packer assemblies 30 in the well system 10 allows rapid isolation of the zones 22*a*, 22*b*, 22*c* to thereby prevent loss of completion fluid into the zones. The valves 28, 38 allow the fluid communication between the annulus 32 and the interior 54 of the completion string 12 to be closed off when desired to prevent loss of fluid to the zones 22*a*, 22*b*, 22*c*, but the valves also permit this fluid communication when desired (for example, to allow stimulation operations to be performed, to allow production of fluid from the zones into the completion string via the screen assemblies 26, etc.).

It may now be fully appreciated that the above detailed description discloses to the art a well completion string 12 which includes at least one set of well tools 20 interconnected as a portion of the completion string. The set of well tools 20 includes at least one well screen assembly 26, at least one valve 28 and/or 38 which selectively permits and prevents fluid communication between an interior 54 and an exterior of the completion string 12, and at least two packer assemblies 30. Each of the packer assemblies 30 includes at least one swellable seal element 42. The packer assemblies 30 longitudinally straddle the valve 28 and/or 38 and the well screen assembly 26 in the completion string 12.

The well screen assembly 26 may include an inflow control device 36 which restricts fluid flow through the screen assembly. The inflow control device 36 may variably restrict the fluid flow at least in response to a proportion of water in the fluid flow. The inflow control device 36 may variably restrict the fluid flow at least in response to a proportion of gas in the fluid flow. The valve 38 may selectively permit and prevent fluid flow through the inflow control device 36.

The packer assembly 30 may include an actuator 44 which radially outwardly extends the seal element 42. The actuator 44 may extend the seal element 42 in response to manipulation of pressure applied to the actuator. The actuator 44 may extend the seal element 42 by application of a mechanical biasing force to the seal element. The seal element 42 may swell at least after the actuator 44 outwardly extends the seal element.

The well completion string 12 may further include multiple sets of the well tools 20*a*, 20*b*, 20*c* for controlling fluid flow between the completion string and each of multiple formation zones 22*a*, 22*b*, 22*c*.

Also provided by the above detailed description is the well completion string 12 which includes at least one set of well tools 20 interconnected as a portion of the completion string, the set of well tools including at least two packer assemblies 30, at least one well screen assembly 26, and the well screen assembly including an inflow control device 36 which restricts fluid flow through the screen assembly. Each of the packer assemblies includes at least one swellable seal element 42. The packer assemblies 30 longitudinally straddle the well screen assembly 26 in the completion string 12.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well completion string, comprising:

at least one set of well tools interconnected as a portion of the completion string, the set of well tools including at least one well screen assembly, at least one valve which selectively permits and prevents fluid communication between an interior and an exterior of the completion string, and at least two packer assemblies;

wherein each of the packer assemblies includes at least one swellable seal element, and an actuator which longitudinally compresses the swellable seal element while the swellable seal element is at least partially swollen, and radially outwardly extends the swellable seal element into sealing engagement with at least one of a casing and a wellbore;

wherein the packer assemblies longitudinally straddle the valve and the well screen assembly in the completion string;

wherein the well screen assembly includes an inflow control device which restricts fluid flow through the screen assembly; and wherein the inflow control device variably restricts the fluid flow at least in response to a proportion of water in the fluid flow.

2. A well completion string, comprising:

at least one set of well tools interconnected as a portion of the completion string, the set of well tools including at least one well screen assembly, at least one valve which selectively permits and prevents fluid communication between an interior and an exterior of the completion string, and at least two packer assemblies;

wherein each of the packer assemblies includes at least one swellable seal element, and an actuator which longitudinally compresses the swellable seal element while the swellable seal element is at least partially swollen, and radially outwardly extends the swellable seal element into sealing engagement with at least one of a casing and a wellbore;

wherein the packer assemblies longitudinally straddle the valve and the well screen assembly in the completion string;

wherein the well screen assembly includes an inflow control device which restricts fluid flow through the screen assembly; and wherein the inflow control device variably restricts the fluid flow at least in response to a proportion of gas in the fluid flow.

3. A well completion string, comprising:

at least one set of well tools interconnected as a portion of the completion string, the set of well tools including at least two packer assemblies, at least one well screen assembly, and the well screen assembly including an inflow control device which restricts fluid flow through the screen assembly, wherein the inflow control device variably restricts the fluid flow at least in response to a proportion of at least one of water and gas in the fluid flow;

wherein each of the packer assemblies includes at least one swellable seal element and an actuator which radially outwardly extends the seal element; and wherein the packer assemblies longitudinally straddle the well screen assembly in the completion string.

4. The well completion string of claim 3, wherein the set of well tools further includes at least one valve which selectively permits and prevents fluid communication between an interior and an exterior of the completion string, and wherein the packer assemblies longitudinally straddle the valve and the well screen assembly in the completion string.

5. The well completion string of claim 4, wherein the valve selectively permits and prevents fluid flow through the inflow control device.

6. The well completion string of claim 3, wherein the actuator extends the seal element in response to manipulation of pressure applied to the actuator.

7. The well completion string of claim 3, wherein the actuator extends the seal element by application of a mechanical biasing force to the seal element.

8. The well completion string of claim 3, wherein the seal element swells at least after the actuator outwardly extends the seal element.

9. The well completion string of claim 3, further comprising multiple sets of the well tools.

* * * * *